US007533738B1

(12) United States Patent
Hall et al.

(10) Patent No.: US 7,533,738 B1
(45) Date of Patent: May 19, 2009

(54) INSERT IN A DOWNHOLE DRILL BIT

(76) Inventors: David R. Hall, 2185 S. Larsen Pkwy., Provo, UT (US) 84606; Casey Webb, 2185 S. Larsen Pkwy., Provo, UT (US) 84606; Ashok Tamang, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/169,288

(22) Filed: Jul. 8, 2008

(51) Int. Cl.
*E21B 10/00* (2006.01)
*E21B 10/36* (2006.01)

(52) U.S. Cl. ..... 175/426; 175/327; 175/331

(58) Field of Classification Search ..... 175/414, 175/415, 420.1, 403, 405, 408, 420.2, 404, 175/381, 385, 379, 321, 57, 327, 331, 426; 81/52, 54, 57, 39, 57.39
See application file for complete search history.

(56) References Cited

U.S. PATENT DOCUMENTS

| | | | | | |
|---|---|---|---|---|---|
| 3,771,612 | A * | 11/1973 | Adcock | ..... | 175/413 |
| 3,805,364 | A | 4/1974 | Gardner | | |
| 4,993,288 | A * | 2/1991 | Anderson et al. | ..... | 81/57.39 |
| 5,678,645 | A * | 10/1997 | Tibbitts et al. | ..... | 175/426 |
| 6,427,791 | B1 * | 8/2002 | Glowka et al. | ..... | 175/413 |

* cited by examiner

*Primary Examiner*—Shane Bomar
*Assistant Examiner*—Yong-Suk Ro
(74) *Attorney, Agent, or Firm*—Tyson Wilde

(57) ABSTRACT

A drill bit assembly has a bit body intermediate a shank and a working face. At least one wear resistant insert is press-fitted within a pocket formed in an outer surface of the bit. An urging element is disposed between the outer surface and a bore of the bit and the urging element is adapted to push the insert away from the bore.

20 Claims, 10 Drawing Sheets

INSERT IN A DOWNHOLE DRILL BIT

BACKGROUND OF THE INVENTION

The present invention relates to drill bits, and more particularly to rock drill bits used in oil and gas drilling, exploration, geothermal drilling, horizontal drilling, and water and mineral drilling.

One drill bit disclosed in the prior art is U.S. Pat. No. 3,771,612 which is herein incorporated by reference for all that it contains, discloses a replaceable wear-resistant element assembly having a wear-resistant element and a mounting device for releasably securing the element in the recess of a supporting body. The mounting device is constructed of a one-piece goblet shaped unit having a sleeve portion for receiving the element therein and a stem portion for supporting the element. The stem and sleeve portions are interconnected by a shearable web portion which will fracture when an axial force of sufficient magnitude is applied to the sleeve to cause the sleeve to move downward about the stem to release the element.

BRIEF SUMMARY OF THE INVENTION

A drill bit assembly has a bit body intermediate a shank and a working face. At least one wear resistant insert is press-fit within a pocket formed in an outer surface of the bit. An urging element is disposed between the outer surface and a bore of the bit and the urging element is adapted to push the insert away from the bore.

The urging element may comprise a threadform adapted to threadingly engage a second threadform formed within the wall of the drill bit. A first end of the urging element may be adapted to contact a base end of the insert and a second end of the urging element may be adapted to receive torque from within the bore of the drill bit. The first end may comprise a diameter narrower than a primary diameter of the urging element.

A wall of the drill bit may comprise a port in communication with the bore. The port may be adapted to receive a plug during drilling operations. The second end of the urging element may comprise a wrench flat. The first end of the urging element may comprise a diamond or cubic boron nitride enhanced. The urging element may comprise a hydraulic press mechanism. The hydraulic press mechanism may comprise an L-shaped fluid reservoir and a piston. The fluid reservoir may be pressurized. The hydraulic press mechanism may be adapted to push multiple inserts at once. The hydraulic press mechanism may be adapted to be activated from the outer surface of the bit.

The drill bit may be incorporated into percussion bits, roller cone bits, rotary drill bits or combinations thereof. The insert may be a gauge pad and a cutting element. The cutting element may comprise a substantially conical profile with a round apex. The pushing mechanism may involve rotation of the tools involved in pushing the press-fit inserts. The diameter of the insert may be greater than the diameter of the port.

DETAILED DESCRIPTION OF THE INVENTION AND THE PREFERRED EMBODIMENT

Figure 1:
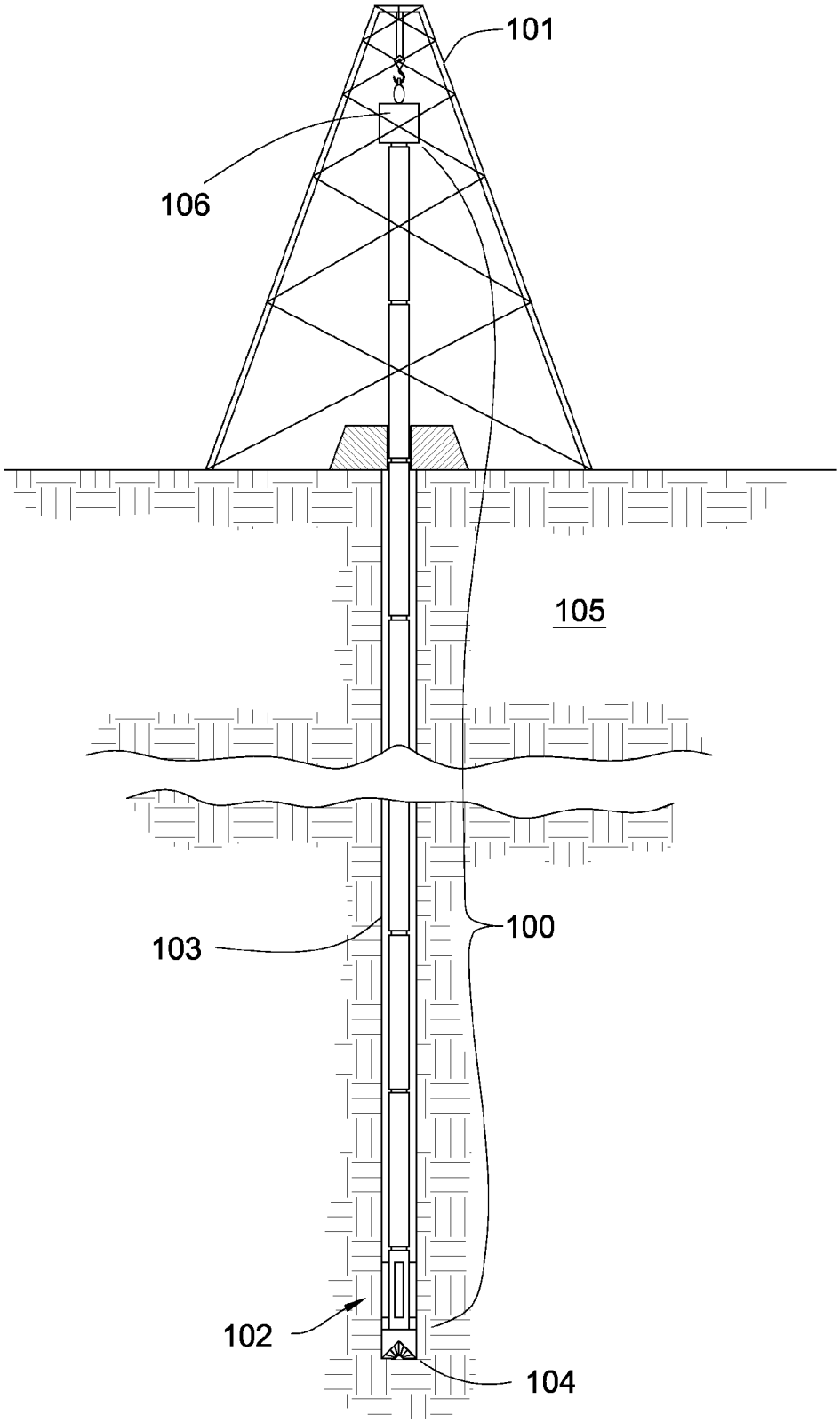
FIG. 1 is a perspective diagram of an embodiment of a drill string suspended in a wellbore.

FIG. 1 is a perspective diagram of an embodiment of a drill string 100 suspended by a derrick 101. A bottom-hole assembly 102 is located at the bottom of a wellbore 103 and comprises a drill bit 104. As the drill bit 104 rotates down hole the drill string 100 advances further into the earth. The drill string 100 may penetrate soft or hard subterranean formations 105. The drill bit 104 may break up the formations 105 by cutting and/or chipping the formation 105 during a down hole drilling operation. The bottom hole assembly 102 and/or down hole components may comprise data acquisition devices which may gather data. The data may be sent to the surface via a transmission system to a data swivel 106. The data swivel 106 may send the data to the surface equipment. Further, the surface equipment may send data and/or power to down hole tools and/or the bottom-hole assembly 102. In some embodiments of the present invention, no telemetry is incorporated in the drill string. The drill string may be used in oil and gas, construction and mining, geothermal, and/or horizontal drilling applications.

Figure 2:
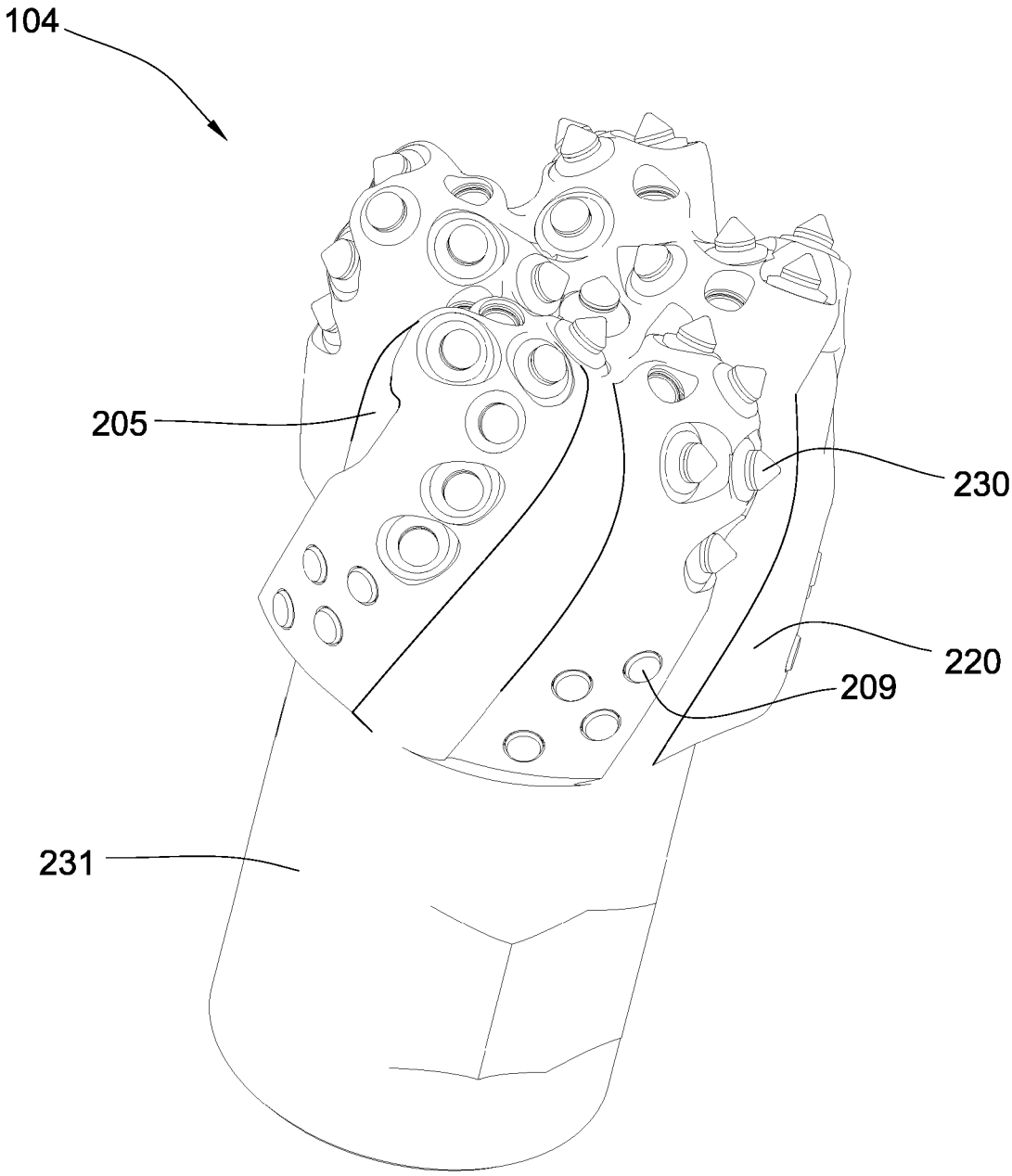
FIG. 2 is a perspective diagram of an embodiment of a drill bit.

Referring now to FIG. 2, the drill bit 104 may comprise a body 205 intermediate a shank 231 and an outer surface 220; the outer surface 220 comprising at least one wear resistant insert press-fit within a pocket formed in the outer surface 220. The wear resistant insert 209 may comprise at least one pointed cutting element 230 or at least one shear cutting element. The insert 209 may comprise a circular geometry. The impact surface of the insert 209 may comprise a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof. In some embodiments, the impact surface may be sintered onto a carbide substrate. The carbide substrate may be brazed with the base of the cutting element with high-strength braze.

Braze material may comprise a melting temperature from 700 to 1200 degrees Celsius; preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may comprise 30 to 62 weight percent palladium, preferable 40 to 50 weight percent palladium. Additionally, the braze material may comprise 30 to 60 weight percent nickel, and 3 to 15 weight percent silicon; preferably the braze material may comprise 47.2 weight percent nickel, 46.7 weight percent palladium, and 6.1 weight percent silicon. The drill bit 104 of the present invention may be intended for deep oil and gas drilling, although any type of drilling application is anticipated such as horizontal drilling, geothermal drilling, exploration, on and off-shore drilling, directional drilling, water well drilling and any combination thereof.

Figure 3:
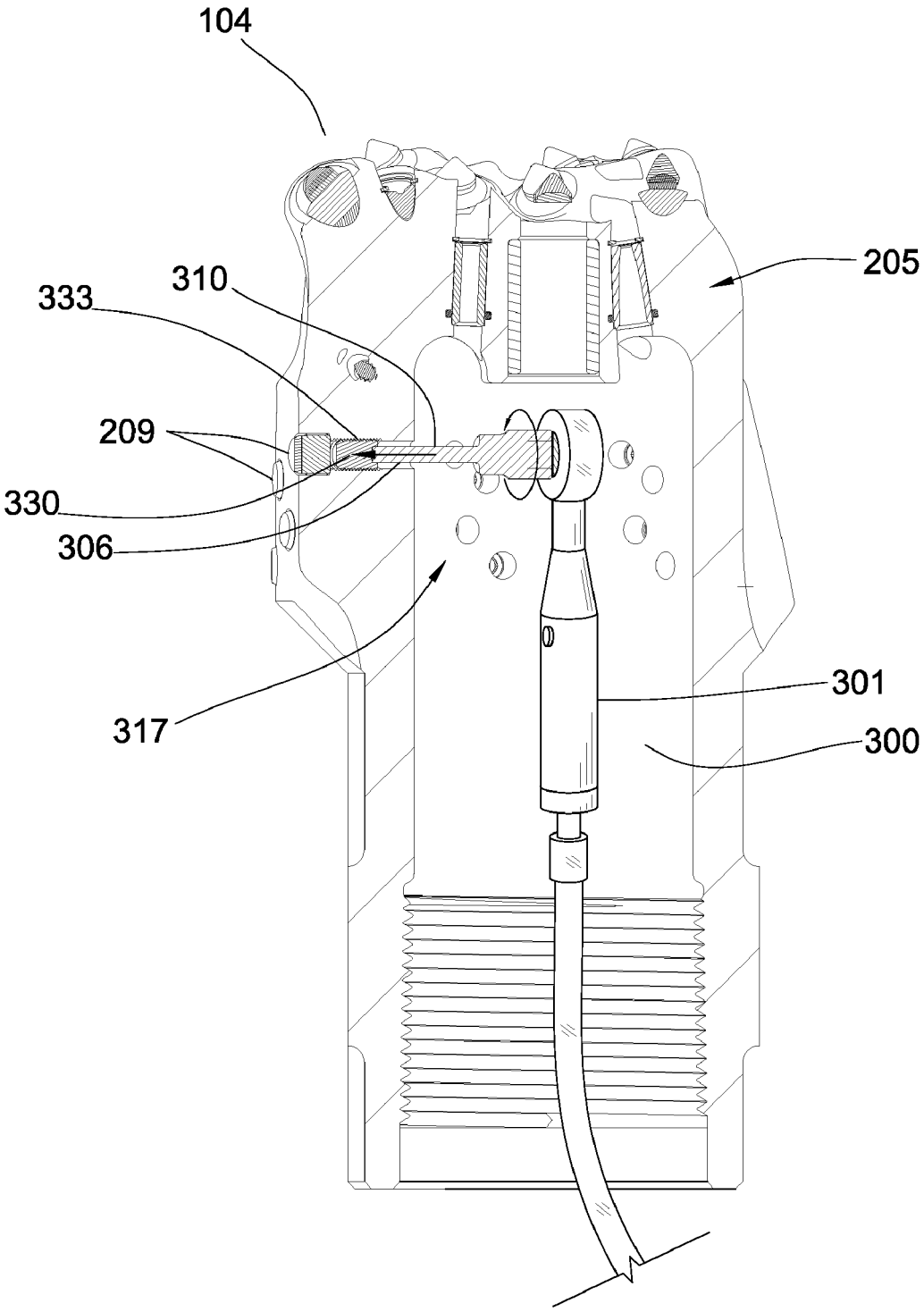
FIG. 3 is a cross-sectional diagram of an embodiment of a drill bit assembly.

Referring now to FIG. 3, the drill bit 104 may comprise a pushing mechanism 317 for pushing the worn out inserts from the bit body 205. The pushing mechanism 317 may comprise a set screw 330, a wrench flat on the set screw such as a hex socket 310 and/or an air ratchet 301. In some embodiments, the wrench flat may be disposed on the outer diameter of the set screw. The bit body 205 may comprise a port 306 underneath the insert 209. A portion of the port 306 may comprise threads 333. In the embodiment of FIG. 3, the set screw 330 is embedded in the port and adapted to receive the threads 333 of the port 306. The set screw 330 may comprise different geometries. The set screw 330 may be adapted to move back and forth within the threaded portion of the port 306. The air ratchet 301 may be inserted inside the bit body through the bore 300. Worn out inserts may be ejected out by the pushing mechanism 317. The air powered ratchet 301 rotates the hex socket 310 which further rotates the set screw 330. The rotation of the air ratchet 301 in the opposite direction may bring the set screw 330 back to its normal position. A new insert may be replaced by press-fitting it inside the drill bit 104.

In some embodiments, a plug is inserted into the port during drilling operations to keep drilling mud and debris out of the port. The plug may comprise a rubber and/or PEEK material. In some embodiments of the present invention the plug is press fit into the port and the removal tool is adapted to break the plug in order to access the port. In other embodiments, the plug may also be a threaded element.

Figure 4:
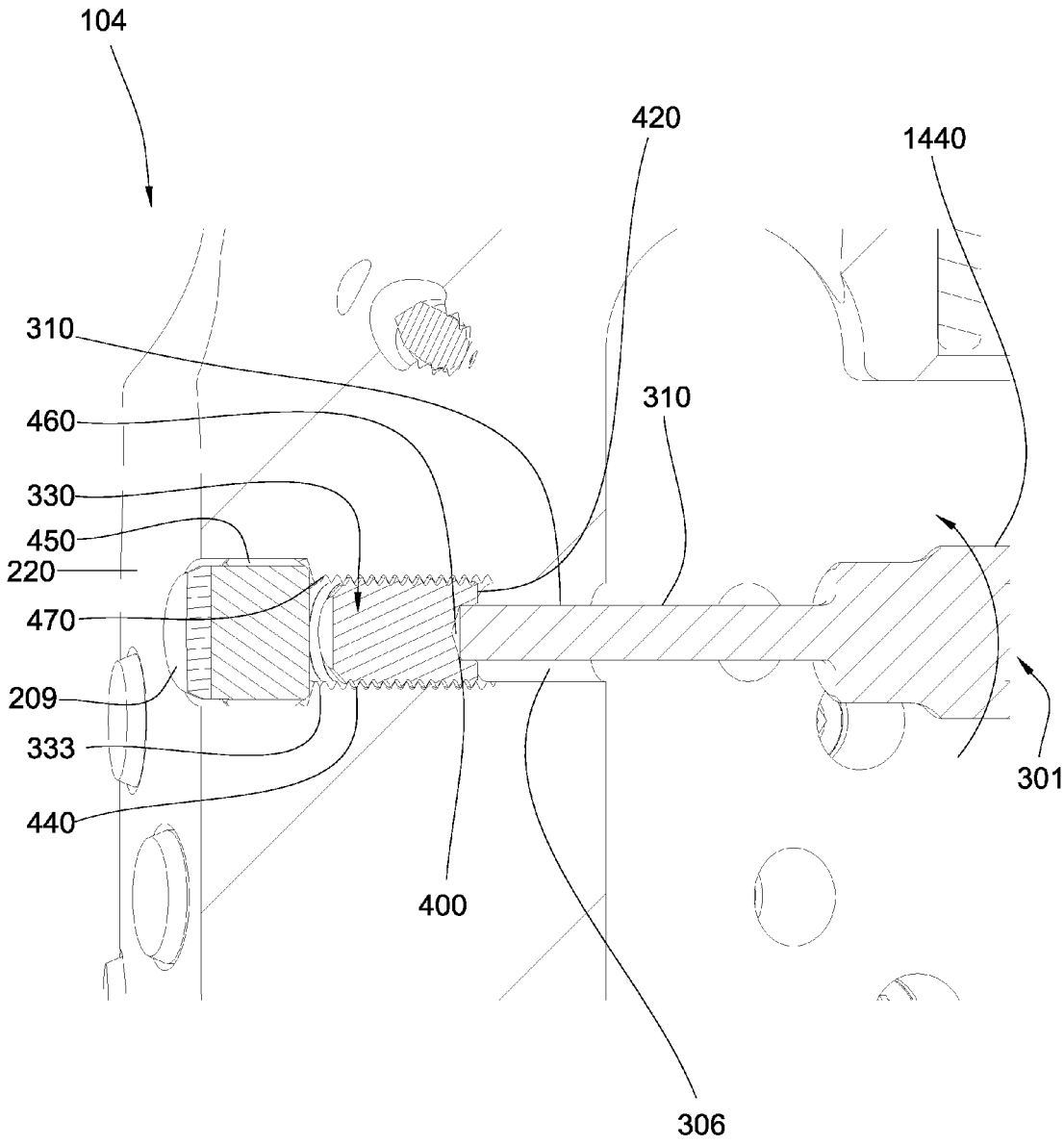
FIG. 4 is a cross-sectional diagram of an embodiment of an insert in a drill bit.

Referring now to FIG. 4, a hex hole in the second end 420 of the set screw 330 may be adapted to receive a first end 400 of the hex socket 310 comprising a hex head 460. A second end 1440 of the hex socket 310 may be adapted to be received by the air ratchet 301. As the air powered ratchet 301 rotates, it may rotate the hex socket 310, and this in turn may rotate the set screw 330. All three components may rotate at the same rate in the pushing mechanism 317. The pushing mechanism 317 may exert force on a base end 470 of the press fit insert 209 sufficient to urge it out without damaging the bit body 205. The threads 333 of the port and the threads 440 in the set screw may comprise same pitch as well as same diameter for alignment. The threads may be triangular or trapezoid or square shaped. A triangular or V-shaped thread may increase the frictional force. Square shaped threads may work well amid the dirt, shavings and other debris.

In some embodiments of the present invention, the insert may be a cutting element on the face of the bit adapted to cut the formation. The insert may be a standard shearing element or it may comprise a chisel, domed, conical, rounded and/or rounded geometry. In some embodiments, the insert may comprises a conical profile with a rounded apex. Such a conical insert may comprise a diamond portion bonded to a carbide substrate. The diamond portion may be over 0.100 inches thick from the substrate to the rounded apex. The conical profile may include an included angle of 75 to 95 degrees. The insert may also comprise a larger diamond volume than carbide volume. In other embodiments, the insert may be a gauge pad.

Figure 5A:
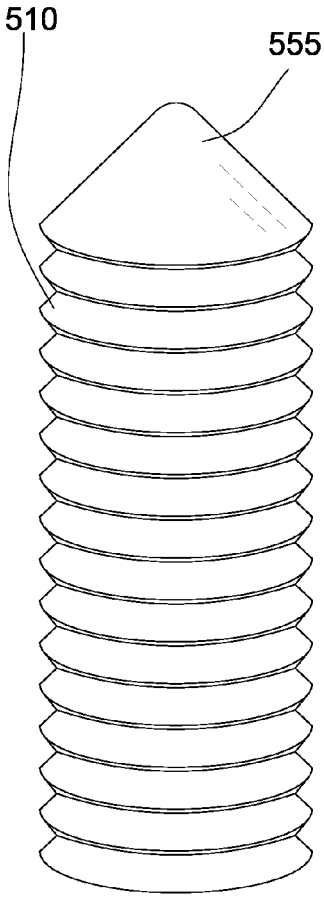
FIG. 5*a* is a perspective diagram of an embodiment of a set screw.
Figure 5B:
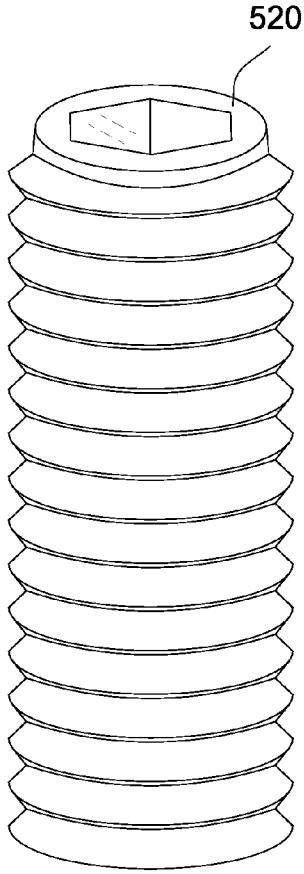
FIG. 5*b* is a perspective diagram of an embodiment of a set screw.
Figure 5C:
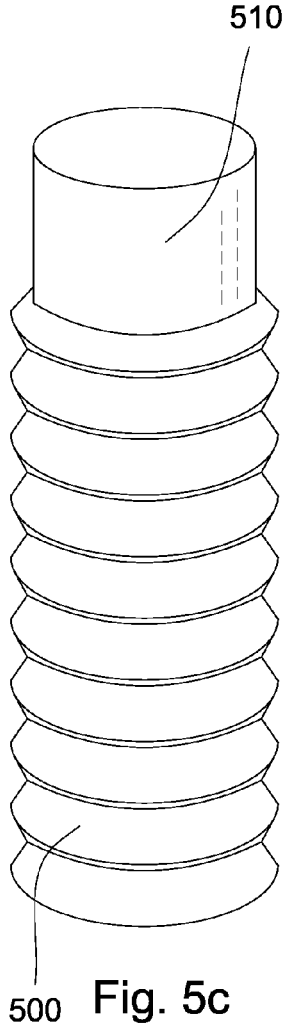
FIG. 5*c* is a perspective diagram of an embodiment of a set screw.

Referring now to FIGS. 5*a-c*, the present invention may comprise different types of set screws. The set screw shown in FIG. 5*a* may comprise a threaded body 510 with a conical head 555. The set screw may comprise brass, bronze, titanium, monel, stainless steel and steel. The set screw may make a point contact with the base end of the insert 209. The applied torque may be concentrated at a tip of the conical head of the set screw. The screw in FIG. 5*b* may comprise a threaded body with a flat head 520. The force exerted by the rotating set screw 330 on the base end of the insert 209 may be distributed uniformly over the surface of the base end. In FIG. 5*c*, the set screw may comprise a cylindrical head 510 and a threaded body 500. The cylindrical head set screw may prevent stripping of the threads and increase the efficiency as well. FIG. 5*c* shows a thread with different characteristics. The cylindrical head set screw may require fewer rotations to remove the insert 209.

Figure 6:
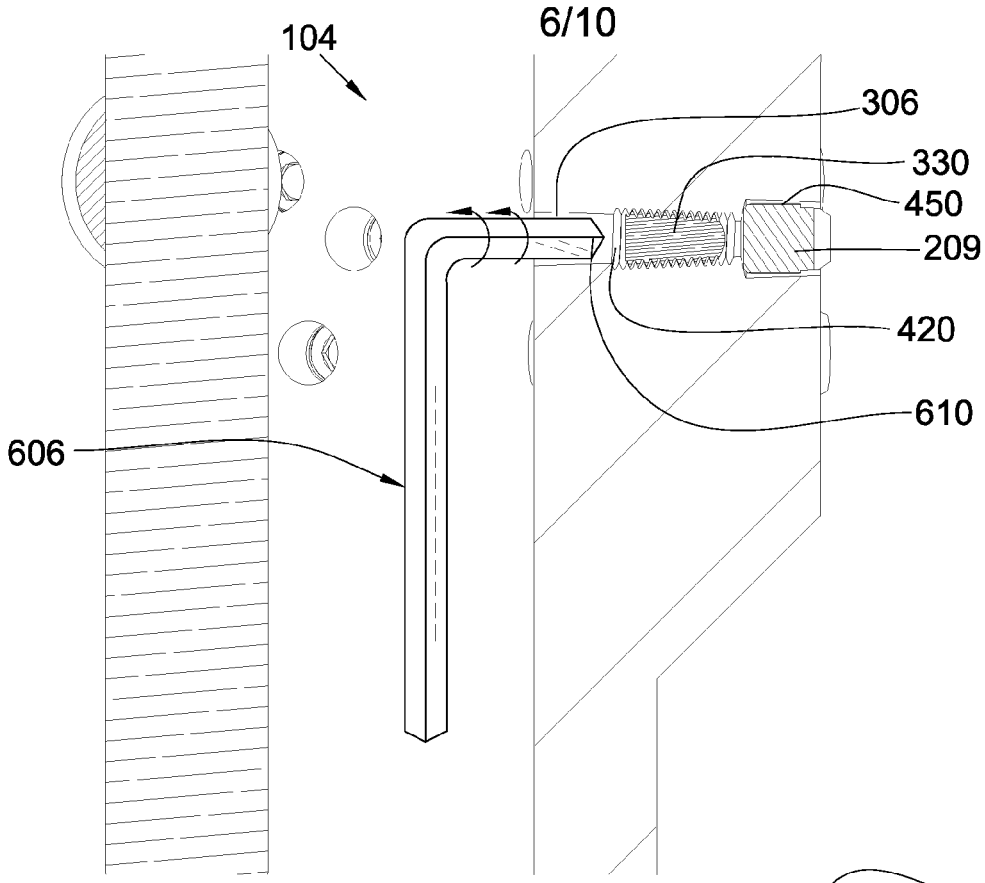
FIG. 6 is a cross-sectional diagram of another embodiment of an insert in a drill bit.

Referring now to FIG. 6, the pushing mechanism may comprise the threaded set screw 330 and an Allen wrench 606. The second end 420 of the set screw 330 may be adapted to receive the hexagonal head 610 of the Allen wrench 606.

Figure 7:
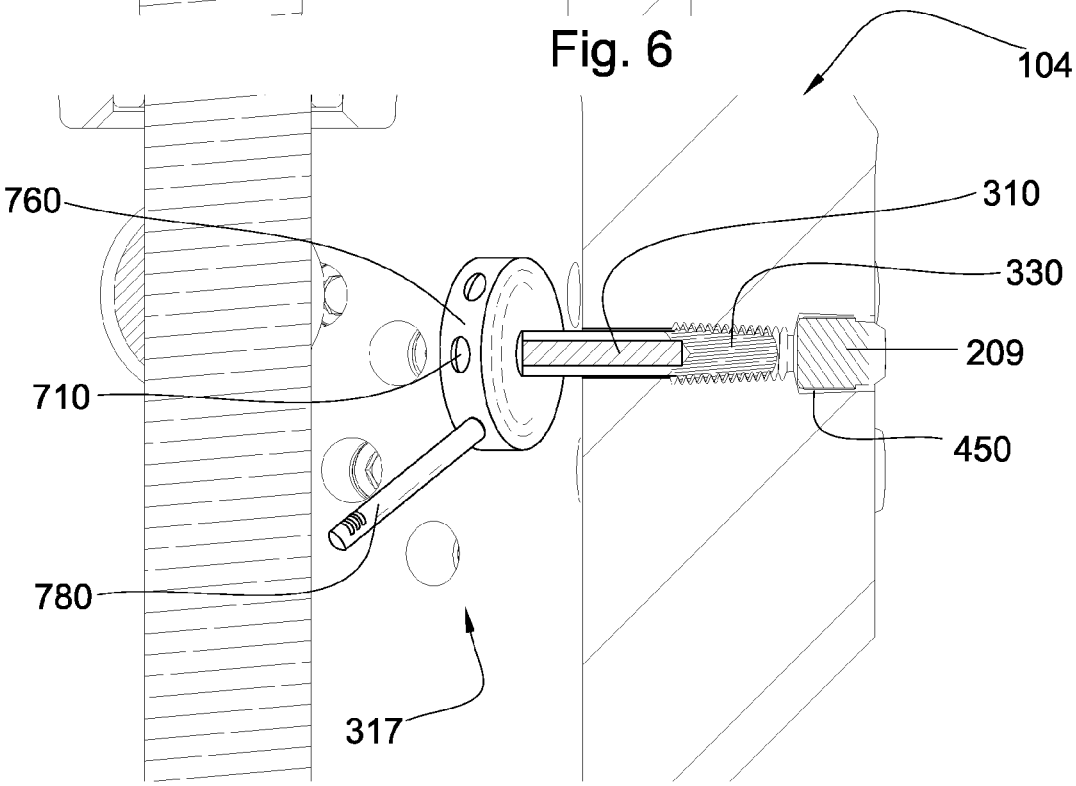
FIG. 7 is a cross-sectional diagram of another embodiment of an insert in a drill bit.

FIG. 7 discloses another mechanism for pushing the insert 209 out of the drill bit 104. In some embodiments, the pushing mechanism 317 may comprise the set screw 330, a hex socket 310 and a rotating wheel 760 with a handle 780. The rotating wheel 760 may comprise hex holes 710 adapted to receive the handle 780. The turnings of the wheel 760 by the handle 780 may produce rotation in the set screw 330 which in turn may urge out the insert 209.

Figure 8:
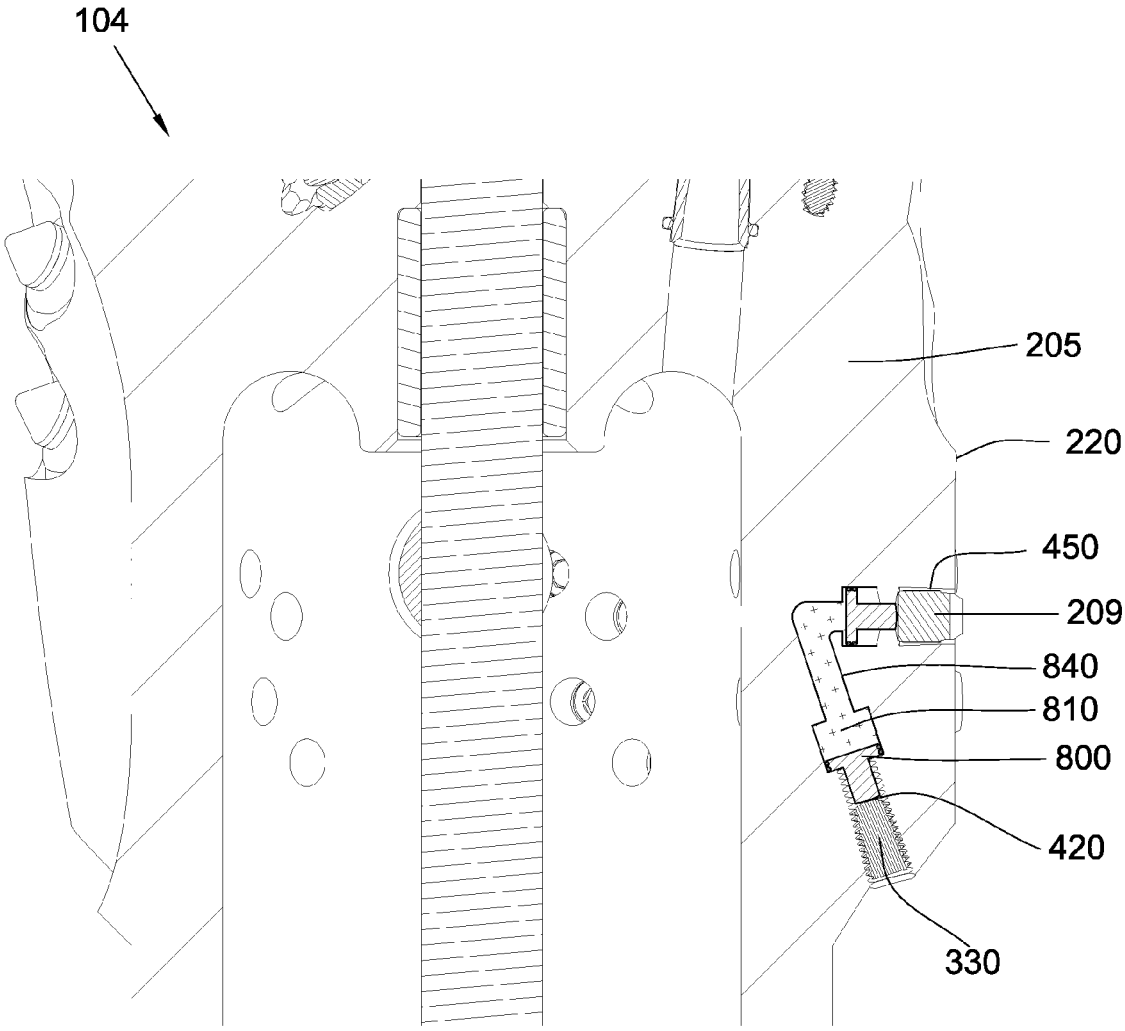
FIG. 8 is a cross-sectional diagram of another embodiment of an insert in a drill bit.

Referring now to FIG. 8, the drill bit 104 may comprise a hydraulic press mechanism. Access to the hydraulic press mechanism may be from the outside of the bit as shown in FIG. 8, although in other embodiments the access may be from the inside for the bit. A plug may also be used to protect the port in this application as well. The set screw 330 may be inserted inside the bit body 205 through the outer surface 220. The set screw 330 may remain inside the drill bit 104 while in operation. The first end of the set screw may push the piston 800 as the screw 330 is rotated. The hydraulic mechanism may comprise a hydraulic fluid 810. The hydraulic fluid 810 may comprise mineral oil, synthetic compounds, water, and water based mixtures. The hydraulic press mechanism may comprise an L-shaped fluid reservoir 840. The piston 800 may push the hydraulic fluid which in turn may push the insert 209 away from the pocket 450. The fluid in the reservoir is stored under high pressure in the hydraulic system.

Figure 9:
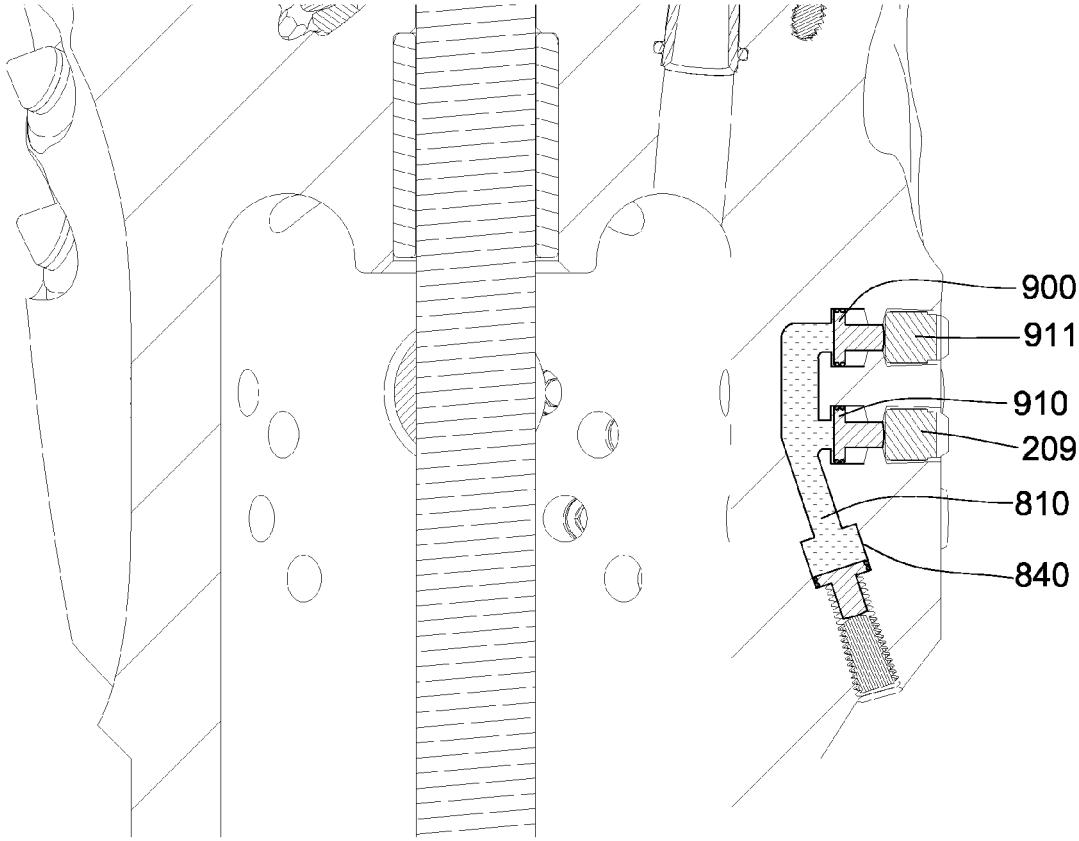
FIG. 9 is a cross-sectional diagram of another embodiment of an insert in a drill bit.

Referring now to FIG. 9, the hydraulic press mechanism may be adapted to push multiple inserts at a time. The reservoir 840 may comprise one inlet but multiple outlets adapted to push the inserts 209 and 911. The pressure applied inside the reservoir 840 may be distributed equally in all the outlets. The pistons 900 and 910 may push the inserts at the same time in the same ratio.

Figure 10:
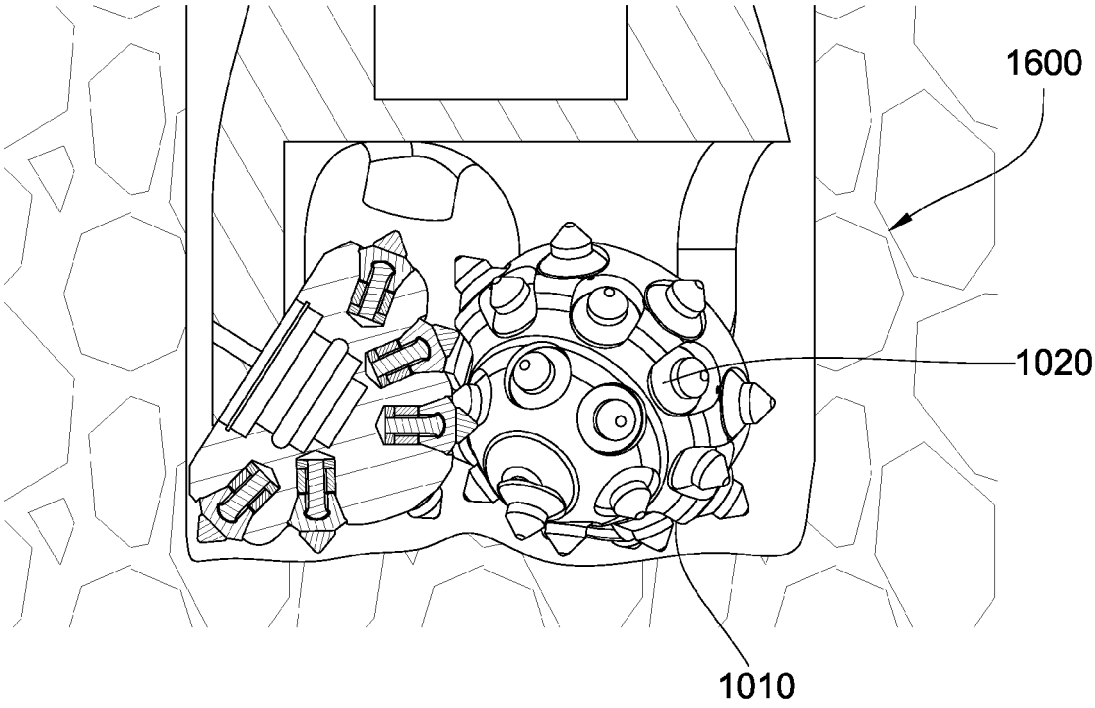
FIG. 10 is a perspective diagram of an embodiment of a roller cone bit.

FIG. 10 discloses an embodiment of the drill bit assembly incorporated into a roller cone bit 1600 which may also incorporate the present invention. The outer surface of the drill bit assembly comprising multiple inserts may be press-fit into a recess formed in the cone 1010 of the roller cone bit 1600.

Figure 11:
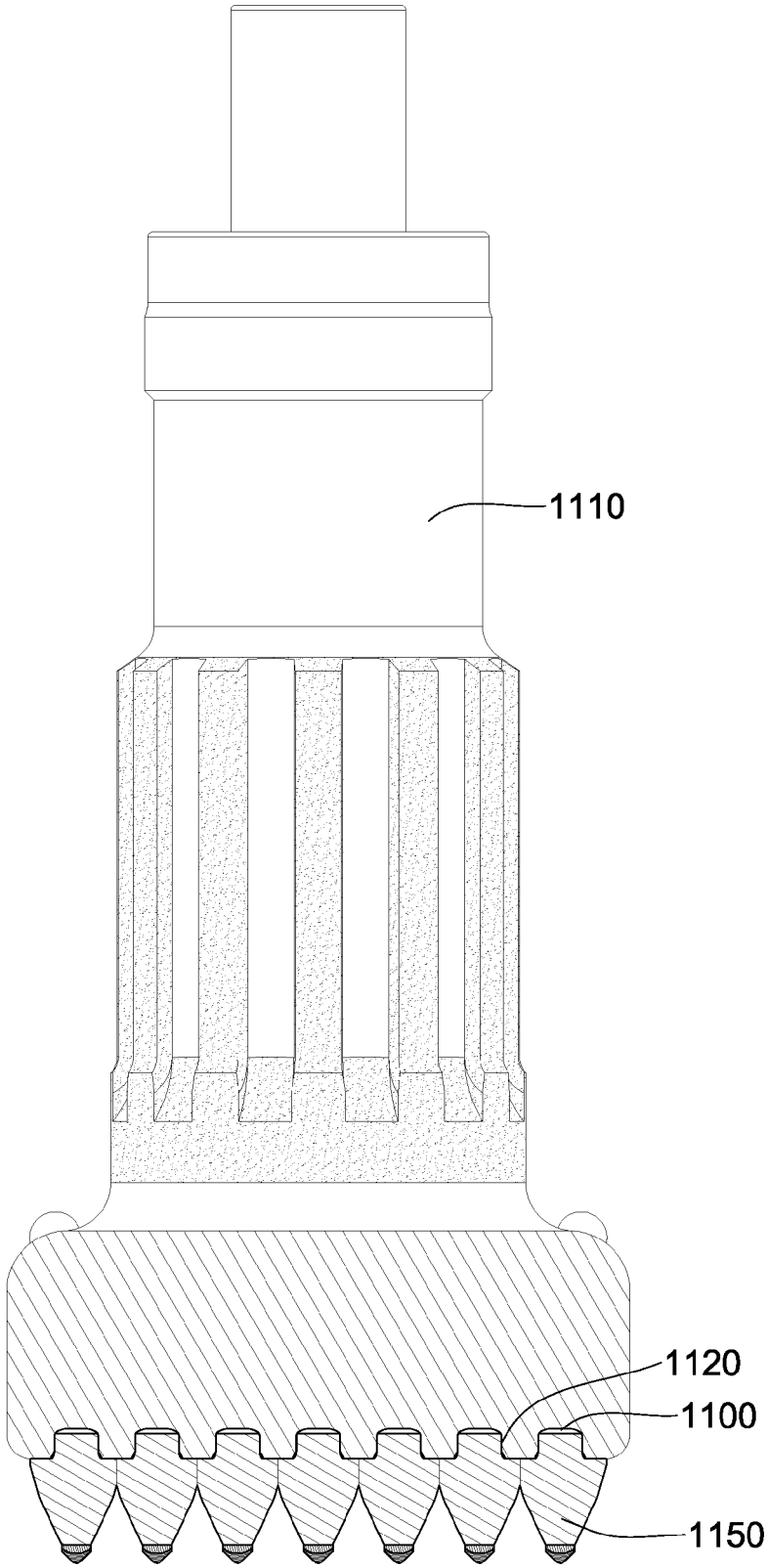
FIG. 11 is a perspective diagram of an embodiment of a percussion bit.

FIG. 11 is a cross-sectional diagram of an embodiment of an insert disposed on a percussion bit 1110. The embodiment may be compatible with the present invention. The percussion bit may comprise a plurality of recesses 1100 adapted to receive the inserts 1150 through a press-fit. The inserts 1150 may comprise a stem 1120 adapted to interlock with the recesses. The inserts 1150 may be press-fit into the recesses 1100. The worn out inserts may be ejected and replaced with new ones by the pushing mechanism 317.

Whereas the present invention has been described in particular relation to the drawings attached hereto, it should be understood that other and further modifications apart from those shown or suggested herein, may be made within the scope and spirit of the present invention.

What is claimed is:

1. A drill bit assembly, comprising:

a bit body intermediate a shank and a working face;

at least one wear resistant insert press fit within a pocket formed in an outer surface of the bit an urging element disposed between the outer surface and a bore of the bit being adapted to push the insert away from the bore.

2. The drill bit of claim 1, wherein the urging element comprises a threadform adapted to threadingly engage a second threadform formed within the wall of the drill bit.

3. The drill bit of claim 2, wherein a first end of the urging element is adapted to contact a base end of the insert and a second end of the urging element is adapted to receive torque from within the bore of the drill bit.

4. The drill bit of claim 2, wherein the first end comprises a diameter narrower than a primary diameter of the urging element.

5. The drill bit of claim 2, wherein a wall of the drill bit comprises a port in communication with the bore.

6. The drill bit of claim 5, wherein the port is adapted to receive a plug during drilling operations.

7. The drill bit of claim 2, wherein the second end comprises a wrench flat.

8. The drill bit of claim 2, wherein the first end of the urging element is diamond or cubic boron nitride enhanced.

9. The drill bit of claim 1, wherein the urging element comprises a hydraulic press mechanism.

10. The drill bit of claim 9, wherein the hydraulic press mechanism comprises an L-shaped fluid reservoir.

11. The drill bit of claim 10, wherein the fluid reservoir is pressurized.

12. The drill bit of claim 9, wherein the hydraulic press mechanism comprises at least one piston.

13. The drill bit of claim 9, wherein the hydraulic press mechanism is adapted to push multiple inserts at once.

14. The drill bit of claim 9, wherein the hydraulic press is adapted to be activated from the outer surface of the bit.

15. The drill bit of claim 1, wherein the drill bit is incorporated into percussion bits, roller cone bits, rotary drill bits or combinations thereof.

16. The drill bit of claim 1, wherein the insert is a gauge pad.

17. The drill bit of claim 1, wherein the insert is a cutting element.

18. The drill bit of claim 17, wherein the cutting element comprises a substantially conical profile with a round apex.

19. The drill bit of claim 1, wherein the pushing mechanism involves rotation of the tools involved in pushing the press-fit inserts.

20. The drill bit of claim 1, wherein the diameter of the insert is greater than the diameter of the port.

* * * * *